United States Patent [19]

Rothman, deceased

[11] 4,005,657

[45] Feb. 1, 1977

[54] PYROTECHNIC NOISEMAKER

[75] Inventor: Barry Rothman, deceased, late of Downingtown, Pa., Shirley Rothman, administratirx

[73] Assignee: Morton C. Jacobs, Philadelphia, Pa.; a part interest

[22] Filed: Apr. 7, 1975

[21] Appl. No.: 565,752

[52] U.S. Cl. ..... 102/37

[51] Int. Cl.[2] ..... F42B 4/16

[58] Field of Search ..... 102/37, 31–33

[56] References Cited

UNITED STATES PATENTS

| | | | |
|---|---|---|---|
| 1,677,034 | 7/1928 | Kohn | 102/37 |
| 2,517,427 | 8/1950 | Hand | 102/37 |
| 3,233,544 | 2/1966 | Hosoya | 102/31 |

FOREIGN PATENTS OR APPLICATIONS

| | | | |
|---|---|---|---|
| 31,912 | 11/1904 | France | 102/37 |

OTHER PUBLICATIONS

Weingart, *Pyrotechnics*, Chemical Publishing Co., Inc., N.Y., 1947, pp. 174–176.

*Primary Examiner*—Verlin R. Pendegrass
*Attorney, Agent, or Firm*—Morton C. Jacobs

[57] ABSTRACT

A pyrotechnic toy noisemaker detonates an explosive charge on impact without hazards of burning or shrapnel. A container with constricted outlet retains solid particles and releases gaseous products.

16 Claims, 9 Drawing Figures

PYROTECHNIC NOISEMAKER

BACKGROUND OF THE INVENTION

This invention relates to a small toy pyrotechnic noisemaker which is safe to use and handle.

There are small noisemaking devices commonly called snappers known in the fireworks and toy trades today. In the current state of the art, the toy noisemakers consist of teardrop-shaped devices approximately one inch long by a quarter-inch diameter at the larger end. Snappers of this type are composed of a small charge of coarse gravel impregnated with minute quantities of impact-sensitive explosive. The explosive gravel is tightly wrapped in a twist-sealed piece of strong tissue paper. When dropped, thrown or crushed, the snappers explode, bursting the tissue wrapper, scattering the gravel charge with some force, and producing a sharp report.

This scattering of gravel constitutes a hazard to the eyes, particularly when the device is used by children.

In addition to the question of safety in use, there are other problems in producing a pyrotechnic noisemaker that are common to many explosive materials; namely, the inherent impulse forces and the potential to cause damage increase substantially when large quantities are packed together for storage or shipment.

Further, there are production problems associated with producing such noisemakers: that of insuring adequate quality control of the explosive content as is required for the maintenance of safety standards, that of making it inexpensively suitable for an expendable toy product.

SUMMARY OF THE INVENTION

It is among the objects of this invention to provide a new and improved toy noisemaker.

Another object is to provide a new and improved toy noisemaker which is safe and harmless to the user.

Another object is to provide a new and improved toy noisemaker which is amenable to good quality control practices and easily and economically manufactured.

Still another object is to provide a device which is acceptable from the standpoint of protection of the environment.

In accordance with one embodiment of this invention, a small length of paper tubing is crimped transversely to its longitudinal axis to form at one end of the tube a receptacle in which is stored an extremely small explosive charge in the form of solid particles. The otherwise open end of the charge storage receptacle is sealed with cement to complete fabrication of the toy device.

Crimping does not accomplish total closure of the tube; the constriction formed by crimping prevents escape of solids in the explosive charge but allows passage of explosively-generated gases when the device detonates. Thus, the crimp acts as a miniature selective valve. The noisemaking qualities of the device are enhanced by using a constriction which momentarily enlarges during the detonation process. Also the tube wall and cement seal are not ruptured by the explosive forces whereby solid materials in the explosive charge are always contained.

Location of the explosive charge near one end of the elongated crimped tube gives ballistic characteristics to the noisemaker such that when thrown or otherwise propelled, the explosive charge is forward as the device follows its trajectory. This forward position assures detonation of the explosive charge upon impact.

DETAILED DESCRIPTION OF THE INVENTION

The above and other objects of this invention, as well as the features thereof will be more readily understood from the following description when read together with the accompanying drawings in which.

Corresponding parts are identified by the same reference numbers throughout the drawings. Drawings are not to scale; relative size of some parts on the drawings has been modified for clarity in presentation.

Figure 1:
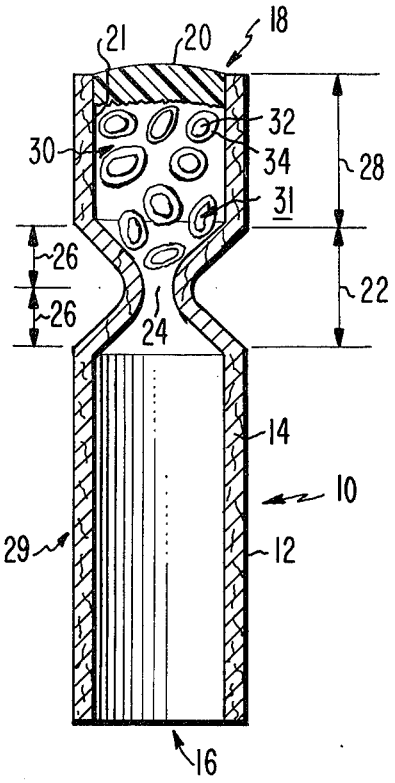
FIG. 1 is an elevational cross-section view of a toy noisemaking device embodying this invention taken along line 1—1 of FIG. 2 and many times enlarged.
Figure 2:
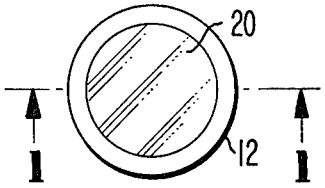
FIG. 2 is a plan view of the toy noisemaking device of FIG. 1.
Figure 3:
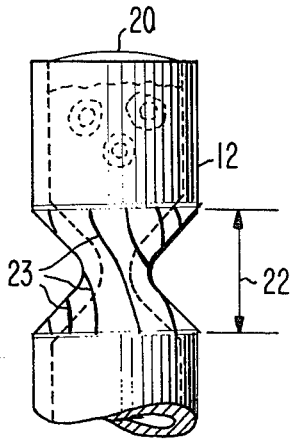
FIG. 3 is a partial elevation view of the device of FIG. 2.

In one embodiment of this invention, FIGS. 1 to 3, a toy noisemaking device 10 comprises an elongated hollow tube 12 (e.g., in one specific illustrative form, approximately 0.25 inch diameter by 1.25 inch long) having a thin wall 14 (e.g., 0.006 to 0.015 inches thick). The lower end 16 of the tube 12 is open; the upper end 18 is closed by a plug 20 composed of a suitable sealant.

Between the ends of the tubing is a short section 22 having a crimped, or otherwise constricted, cross-section. This constricted section 22 is a permanent deformation in the tube that results when the tubing is stressed beyond its elastic limit by torsional forces exerted about its longitudinal axis (FIG. 3). The crimping may be formed by twisting the tube and applying pressure at the desired point of constriction. The resulting crimp 22 has a permanent twist impressed in the wall of the tube as indicated by the twist lines 23 in FIG. 3.

Figure 4:
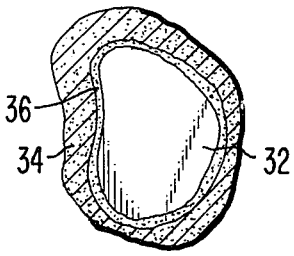
FIG. 4 is an enlarged view of an element of explosive charge.

Located in the compartment 30 formed between plug 20 and constriction 22, is the explosive charge 31 which is comprised (FIG. 4) of a plurality of small nonexplosive particles 32 (e.g., fine gravel such as No. 3 sand used in sand blasting operations) covered with an explosive coating 34, e.g., a thin coating of silver fulminate ($Ag(ONC)_2$), bonded thereon using a suitable adhesive 36, e.g., a water-soluble casein glue. Less than one gram of explosive charge 31 using a combination of silver fulminate and gravel (e.g., the ratio of silver fulminate to gravel is 0.5 to 2.0% by weight) is effective to produce a satisfactory noisemaking device which is safe to use.

Paper, e.g., conventional kraft paper, uncoated on its exterior surface and twist-wrapped is a suitable material for the tube 12 of this invention. When the paper tube 12 is deformed by twisting as described above, the narrowest opening 24, or throat, in the constriction 22 occurs approximately centered between two opposed generally conical sections 26. Thus, the constriction 22 as seen in longitudinal cross-section has general contours (FIG. 2) similar to an hourglass.

The permanently deformed paper tube 12 retains a degree of elasticity. After application and release of a small rotational force which slightly untwists the paper at the constriction 22, the tube 12 returns to the approximate condition of deformation which existed prior to the application of the untwisting force. Succinctly stated, the paper tube 12 of this invention once permanently deformed by twisting has a "memory" and recovers from subsequent slight twisting after the subsequent small torsional force is removed. As the tube 12 is untwisted, the throat 24 of the constriction 22 enlarges; when the tube 12 returns to its static (but still twisted) position, the throat 24 contracts to a size approximating its static size.

The constriction 22 is located longitudinally along the tube at a distance 28, (about one-third the length of the tube for the dimensions given above) which produces the compartment 30 bounded by the cement plug 20 at the top 18, the tube wall 14 and the constriction 22. This compartment 30 has a small measured volume sufficient to hold a suitably small amount of explosive charge 31 therein without allowing substantial movement of the explosive material. The substantially uniformly fixed dimensions of the storage compartment 30 for explosives prevents overcharging with explosive and assures a narrow range of charge quantity between individual devices whether production is by hand or by highly automated methods. The longer open tube section 29 has ballistic advantages noted below.

Potential loss of explosive through the constricted opening 24 which might otherwise occur if the explosive were in powdered or small granular form is prevented by applying the explosive as a coating 34 to the larger nonexplosive particles 32.

After loading the coated particles 32 in tube compartment 30, cement, e.g., sodium silicate and chalk, is applied to the tube end 18 in an unset condition, whereby the cement hardens in place to form the plug 20, and at the same time attaches to and provides a sealed bond with the inner surface 21 of the tube 12.

Aside from the "memory" characteristics of the paper tube when twisted as described above, kraft paper is biodegradeable and therefore nonpolluting. Additionally, an uncoated kraft paper surface readily absorbs moisture. When a noisemaker device using the kraft paper tube is placed in the mouth, it quickly absorbs saliva. This tends to induce gagging and makes swallowing more difficult to accomplish. The extended length of the tube, e.g., 1.25 inches, and its stiffness, also discourage swallowing. For both these reasons, this noisemaker is safe when used by small children.

It is noteworthy that an embodiment comprising a kraft paper tube, gravel, silver fulminate explosive, casein binder, and cement formulated with sodium silicate and chalk as described above, is nontoxic when ingested and is fully biodegradeable as a waste product. These materials are used in a preferred embodiment. Various subcombinations of these materials may be used and other materials may be used in the place of one or more of them to achieve substantially the advantages of this invention.

The noisemaking device 10 is activated by crushing or impacting against a hard surface which causes some particles 32 in the compartment 30 to make sharp and abrasive impact with each other igniting the explosive coating 34 and detonating the entire explosive charge. The irregular shape of the gravel particles 32 substantially assures that points of concentrated pressure exist betwen particles during impact to initiate the explosive reaction. Unintended discharge of the device without crushing or impact is prevented by the construction of the particles 32 tightly filling the explosive charge compartment 30 and therefore being unable to move relative to each other.

The volume of gas generated in the compartment 30 as a product of the explosive reaction rushes through the constricted passage 24 and escapes to the ambient environment creating noise in the process. Additionally, the gas pressure rapidly builds up in the compartment 30 upon detonation of the explosive charge causing the constriction 22 in the tube to untwist slightly whereby there is an enlargement of the opening 24 through the constriction 22. The gaseous products escape more rapidly through the enlarged opening 24 than would otherwise occur and the noiseproducing capability of the device 10 is enhanced thereby.

When the gas pressure in the compartment 30 has been relieved, the "memory" of the twisted paper tube 12 acting as described above returns the tube 12 and the constricted opening 24 to the same approximate condition and size as existed prior to the explosion. The higher mass of the nonexplosive particles 32 prevents their rapid acceleration and passage along with the gaseous products through the constriction 22 during the extremely short time period when gas pressure is elevated in the compartment 30 and the opening 24 in the constriction 22 is enlarged. Rapid contraction of the opening 24 at the constriction 22 then prevents escape of the solid particles 32 and eliminates all hazard of personal injury from this source.

In effect, the constriction 22 provided by twisting and permanently deforming a paper tube 12 as described above is in the nature of a rapidly operating iris having an opening 24 which enlarges when a sufficient gas pressure differential exists across the opening 24 and contracts when the gas pressure is relieved. By this action gaseous products rapidly escape through the constriction and the slower moving solid particles 32 are prevented from passage.

Figure 5:
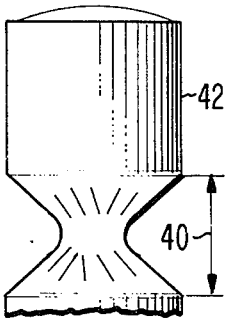
FIG. 5 is a partial elevation view of another embodiment of a noisemaking device of this invention.

In an alternate embodiment (FIG. 5) of this invention, the constriction 40 is formed by a simple choke crimp applied circumferentially to the tube 42. However, this restriction lacks the advantage of flexibility found in the twisted tube (FIGS. 1–3), (i.e., the expanding-contracting iris action is absent) and is a less effective producer of noise.

Figure 6:
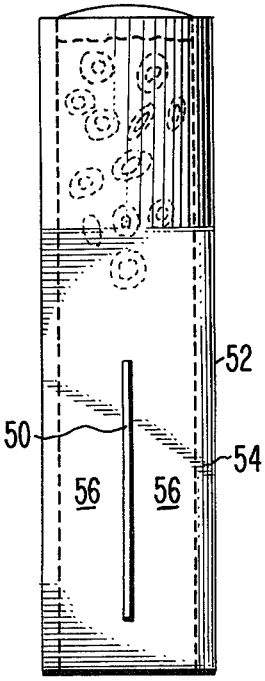
FIG. 6 is a front elevation view of another embodiment of this invention.
Figure 7:
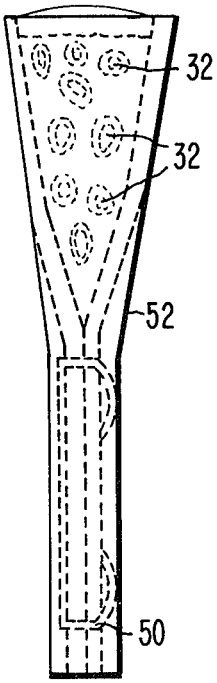
FIG. 7 is a side elevation view of the embodiment of FIG. 6.
Figure 8:
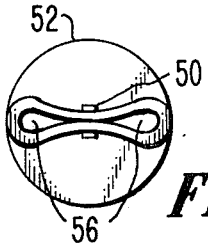
FIG. 8 is a bottom view of the embodiment of FIG. 6.

An alternate embodiment (FIGS. 6, 7, 8) uses a fastener 5 (e.g., a staple) oriented generally parallel with the longitudinal axis of the tube 52 to pierce the tube wall 54, to flatten the tube 52 and to form two constricted passages 56 for gaseous discharge. This configuration also allows some enlargement of the flow area through the constrictions 56 upon detonation of the explosive charge and some contraction following escape of the gaseous products. However, it has been found, the sound output tends to be attenuated by the extended length of the constricted passageway 56.

Locating the explosive charge substantially at one end 18 of the tube 12 imparts ballistic characteristics to the device 10 such that when thrown or otherwise projected, the tube end 18 containing the explosive charge is first to impact against the ground or a wall. Misfirings which might otherwise occur were the explosive charge to be centrally located in the tube are reduced. Also a more controllable and predictable trajectory resulting from the end-heavy construction is a safety feature when the device is propelled through the air.

The invention of this disclosure overcomes the safety hazard and quality control difficulties existing in current toy noisemakers by using extremely small measured amounts of explosive material. The design and construction eliminates potential hazards from burning and from projected fragments of solid material. Explosive output is primarily in the form of noise. The noisemaker of this invention can, in fact, be discharged between bare fingers without danger and will not ignite even gasoline vapor or loose black gunpowder. An entire shipping case containing thousands of these noisemakers of this invention will not explode with sufficient force to rupture a cardboard container holding them for shipment, for the total quantity of charge is so small and the charge per unit volume is likewise small. The noisemaker, if ingested, is nontoxic in its effect on the person. However, to discourage swallowing the noisemaker is generally tubular in shape and has an extended length. The container is fabricated of moisture-permeable paper which absorbs saliva, tends to induce gagging and further discourages swallowing thereby. Each component of the noisemaker of this invention may be either a natural material or completely biodegradeable, so that no polluting effects are felt in the environment.

Various other modifications of this invention may be made and will be apparent to those versed in the art from the foregoing description which is presented by way of illustration of and not as a limitation on the scope of this invention. For example, in alternative embodiments of this invention, other impact-sensitive explosive materials as are known to those versed in the art may be utilized. For example, fulminate of mercury, silver picrate or silver azide may be used. However, fulminate of mercury is known to be highly toxic; the picrate may have toxic qualities and the azide is substantially less sensitive to impact than is silver fulminate.

Additionally, in other embodiments the constricted tube may be of metal, e.g., aluminum, or plastic; however, these materials tend to be slippery when covered with saliva and more easily swallowed. Also, environmental factors (e.g., biodegradeability) and production costs may be less favorable.

The tube length may be shortened with the tube 12 cut off at any position downstream of the constriction 22 (i.e., at any position having an unrestricted passage to the ambient environment) without adversely affecting noisemaking performance. However, the hazard of a child swallowing the noisemaker decreases as overall length increases.

Figure 9:
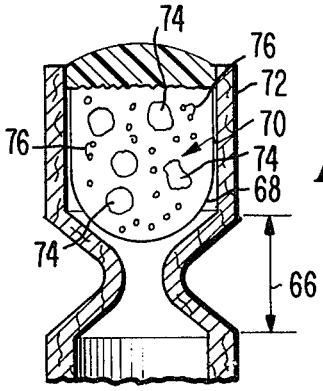
FIG. 9 is a partial cross-section elevational view of another embodiment of this invention.

In still another alternative embodiment, FIG. 9, the constriction 55 may be spanned by a thin internal membrane 68, e.g., tissue paper, or other barrier which ruptures without release of harmful fragments when the gas pressure within the chamber 70 builds up upon detonation. After rupture of the membrane or other barrier the gases escape through the constriction 66 in the tube 72 and the solid nonexplosive particles 74 are blocked from passage as described above. In this alternative embodiment the explosive material 76 need not be bonded to the inert particles 74 and the explosive charge may comprise explosive material in loose powder or fine granular form 76 mixed with inert particles 74 of larger size, e.g., No. 3 blasting sand. The membrane or barrier prevents loss of explosive powder or grains prior to detonation.

In other alternative embodiments, instead of crimping the wall of the tube, the constriction may be formed by an internal plug with an opening of suitable size. Also, the flexible gas-release passage can be achieved with various flexible materials for such a plug, or for the entire container itself.

Accordingly, a new and improved noisemaker is provided by the above-described invention. It is safe and harmless so that children may use it. It is economically manufactured and is not harmful to the environment.

What is claimed is:

1. A noisemaking device comprising:

a thin-walled container having a constricted passage to pass explosive gas out of said container;

a small explosive charge inside said container and a plurality of particles for detonating said charge on impact to produce an explosive force of a certain magnitude, the size of said particles being greater than that of said constricted passage and thereby blocked with said charge from passing therethrough during quiescence, the wall of said container being sufficiently thin to expand substantially said constricted passage under pressure of gas produced by detonation of the explosive charge to release said pressurized gas and produce a desired noise and retain said particles safely within said container, and having strength sufficient to withstand without rupture said explosive force produced within the container upon detonation of said explosive charge and release of said pressurized gas.

2. A noisemaking device as recited in claim 1 wherein said constricted passage contracts when the gas pressure subsides.

3. A noisemaking device as recited in claim 1 wherein:

said container is generally tubular and generally closed at one end and said constricted passage is formed along the tubular axis and surrounded by the tubular wall.

4. A noisemaking device comprising:

a container having a constriction for passage of explosive gas out of said container;

an explosive charge inside said container comprised of particles detonatable on impact, the size of said particles being greater than that of said constriction and blocked from passage therethrough during quiescence, said constriction being expandable under pressure of gas produced by detonation of the explosive charge;

the wall of the container having strength sufficient to withstand without rupture the explosive forces produced within the container upon detonation of said explosive charge;

said container being an elongated thin-walled tube closed at one end and twisted about its longitudinal axis to produce said constriction in the wall thereof.

5. A noisemaking device as recited in claim 3 wherein the walls of said container are about 0.015 inch thick or less.

6. A noisemaking device as recited in claim 1 wherein said particles are coated with said explosive charge.

7. A noisemaking device as recited in claim 6 wherein the quantity of coated particles is less than 1 gram with the ratio of explosive coating to particles being within the range of up to about 2% by weight.

8. A noisemaking device as recited in claim 7 wherein said particles are gravel coated with silver fulminate.

9. A noisemaker comprising:

an elongated device of lightweight thin material having a generally closed explosive chamber with an impact wall at one end and an exhaust opening at the opposite end, and an integral elongated open passageway directly communicating with said chamber opening and projecting from said chamber away from said impact end for exhausting explosive gas from said chamber;

an explosive charge within said chamber comprised of particles having an explosive coating detonatable on impact to produce an explosive force of a certain magnitude, said particles being larger than said exhaust opening and thereby blocked from passage therethrough during quiescence;

the wall of said chamber having strength sufficient to withstand without rupture said explosive forces upon detonation of said explosive charge and exhausting of said gas through said opening;

said particles having a substantial mass to provide a heavy impact end to said device at said chamber and tending when propelled through the air to give said device a ballistic characteristic so as to impact against a chosen object; whereby the explosive gases are exhausted through the constricted open passage at the opposite end, and said particles are safely retained within said chamber.

10. A noisemaker as recited in claim 9 wherein the length of said chamber is less than half the length of said passageway.

11. A noisemaker as recited in claim 10 wherein the overall length of said device is about an inch or more.

12. A noisemaker as recited in claim 9 wherein said exhaust opening expands under said explosive force produced by detonation of the explosive charge.

13. A noisemaker as recited in claim 12 wherein said exhaust opening contracts upon subsidence of said explosive force.

14. A noisemaker as recited in claim 9 wherein said particles are gravel coated with silver fulminate.

15. A noisemaker as recited in claim 14 wherein the quantity of coated gravel is less than 1 gram with the ratio of silver fulminate to gravel is less than about 2% by weight.

16. A noisemaking device comprising:

a thin-walled chamber;

a small explosive charge inside said chamber formed of particles having an explosive coating detonatable on impact;

said chamber being generally closed and having an exhausting opening through the wall thereof of size less than that of said particles to block passage thereof during quiescence;

the quantity of said coated particles being less than about 1 gram with the ratio of explosive coating to particles being within the range of up to about 2% by weight;

whereby said device may be safely handled and is effective to produce a substantial noise upon detonation.

* * * * *